United States Patent [19]

Binder et al.

[11] Patent Number: 4,457,058

[45] Date of Patent: Jul. 3, 1984

[54] TAKE-OFF ROLL FOR FIBER BALES

[75] Inventors: Rolf Binder, Raeterschen; David Egloff, Eschlikon; Daniel Hanselmann, Winterthur, all of Switzerland

[73] Assignee: Rieter Machine Works Ltd., Winterthur, Switzerland

[21] Appl. No.: 345,141

[22] Filed: Feb. 2, 1982

[30] Foreign Application Priority Data

Feb. 20, 1981 [CH] Switzerland ..... 1134/81

[51] Int. Cl.[3] ..... B21B 31/00

[52] U.S. Cl. ..... 29/125; 241/294; 29/123

[58] Field of Search ..... 29/125, 123, 126, 130; 241/294, 295

[56] References Cited

U.S. PATENT DOCUMENTS

| | | | |
|---|---|---|---|
| 1,396,108 | 11/1921 | Gilmore, Jr. | 241/294 |
| 1,614,789 | 1/1927 | Finger | 29/123 |
| 1,798,000 | 3/1931 | Schultz | 241/294 |
| 3,237,276 | 3/1966 | Von der Uhe | 29/123 X |
| 4,241,882 | 12/1980 | Baikoff | 241/295 X |

FOREIGN PATENT DOCUMENTS

| | | | |
|---|---|---|---|
| 565907 | 2/1923 | France . | |
| 1528453 | 4/1968 | France . | |
| 394430 | 6/1933 | United Kingdom | 241/294 |

*Primary Examiner*—Howard N. Goldberg

*Assistant Examiner*—Carl J. Arbes

*Attorney, Agent, or Firm*—Werner W. Kleeman

[57] ABSTRACT

A take-off roll for opening fiber bales by loosening fiber flocks therefrom contains toothed discs mounted along and upon rotatable shaft. Each toothed disc comprises semi-circular or half-discs which substantially are in the form of half a circular ring. An approximately half or semi-circular ring-shaped cup is provided for each half-disc. Each of the half-discs is embedded in the cast cup or cup member, and the cup members of the half-discs which are assembled together to form one of the toothed discs surround the shaft in a substantially ring-shaped manner. The cup members are releasably mutually fixed and rigidly connected to the shaft by a press fit. Certain advantages of the inventive take-off roll consist in easy replacement of any damaged half-disc and its cup member, and a free adaptability of the staggering of the teeth between the toothed discs. This permits elimination of the occurrence of undesirable vibrations of the take-off roll. Finally, the embedding of the half-discs in the cast cup members permit, within wide limits, the choice of the optimum material for each of these parts. Thus, for instance, the cup members can be fabricated from a lightweight material and the half-discs from a very hard material.

20 Claims, 3 Drawing Figures

TAKE-OFF ROLL FOR FIBER BALES

BACKGROUND OF THE INVENTION

The present invention relates to a new and improved construction of a take-off roll for mechanically opening and taking-off or breaking apart fiber bales by loosening fiber flocks therefrom while using circular ring-shaped toothed discs mounted along and upon a rotatable shaft, these toothed discs being provided on their outer circumference with teeth.

From Swiss Pat. No. 376,403 a bale opener has become known to the art according to which rotating sawtooth discs, which protrude between grid bars or rods towards fiber bales moved over the grid bars, are arranged to wobble or carry out a reeling motion, i.e. these discs are arranged at an angle differing from 90 degrees with respect to their axis of rotation. The discs are arranged upon a shaft and are pressed between spacer members using tension anchors.

In practice it has been found that fiber bales of fiber material to be processed, in particular bales containing natural fibers, frequently contain foreign matter (e.g. metal particles, stones and so forth). The teeth of the toothed discs upon colliding with such foreign bodies or parts are damaged, and thus, depending upon the prevailing circumstances rendered unsuitable within a shorter on longer period of time. Consequently, the disc with the damaged tooth must be replaced. A disadvantage of the known bale opener resides in the fact that for replacing a disc of this type the shaft supporting the discs, including the discs, the spacer members, and the tension anchors, must be removed, dismantled, and upon insertion of the new disc again reassembled and mounted. Replacement of a disc thus entails a great deal of work and causes a relatively long downtime or interruption in the operation of of the equipment.

Furthermore, due to the use of tension anchors which must be inserted through the openings provided in the toothed discs, there is present a limited circumferential alignment or adjustment range of the discs. Thus, the tooth sequence or staggering of the teeth over different discs cannot be freely chosen.

SUMMARY OF THE INVENTION

Therefore, with the foregoing in mind it is a primary object of the present invention to provide a new and improved construction of take-off roll for fiber bales or the like which is not associated with the aforementioned drawbacks and limitations of the prior art.

Another and more specific object of the present invention is directed the provision of a new and improved construction of take-off roll for fiber bales which contains toothed discs capable of being readily and easily replaced, without the need to totally dismantle the take-off roll, in the event of tooth damage.

Still a further significant object of the present invention relates to a new and improved construction of take-off roll for mechanically opening and breaking apart fiber bales by loosening fiber flocks therefrom, wherein such take-off roll utilizes toothed discs extending in the lengthwise direction of the take-off roll, these toothed discs being structured and arranged such that replacement of damaged toothed discs or parts thereof can be conveniently prefected without the need for complicated repair work and while mimimizing downtime of the equipment.

Yet a further important object of the present invention is concerned with a new and improved construction of take-off roll for fiber bales containing an arrangement and structure of the toothed discs such that each toothed disc is formed of substantially semi-circular configured discs affixed in a related cup member such that it is possible to remove the semi-circular configured disc containing damaged teeth without the need to dismantle the entire structure of the take-off roll, and furthermore, there is enabled a random orientation of the teeth of the toothed discs in a selected staggered configuration in the lengthwise extent of the take-off roll.

Another important object of the present invention is concerned with a new and improved construction of take-off roll for fiber bales, which is relatively simple in design, extremely economical to manufacture, highly reliable in operation, and can be repaired relatively easily and with minimum effort.

Now in order to implement these and still further objects of the invention, which will become more readily apparent as the description proceeds, the take-off roll for fiber bales according to the present development is manifested by the features that each of the toothed discs contain two semi-circular or half-discs which essentially possess the shape of a semi-circular or half ring. For each half-disc there is provided an approximately half or semi-circular ring-shaped cup member or shell, and each half-disc is embedded, as by casting, in a related cup member or shell. The cup members or shells of the half-discs, assembled together to form a toothed disc, encircle in a ring-shaped configuration the shaft member, are releasably attached to one another and fixedly or rigidly connected with the shaft by a press fit.

In accordance with the invention there is thus realized the advantage that the toothed discs can be set in any desired circumferential position. Hence, there are beneficially avoided the limitations of the prior art in this regard, such as arise when using the aforementioned tension anchors or a key groove.

Since it has been found that undesirable vibrations of the take-off roll can be avoided, or at the least substantially reduced, if the teeth of different toothed discs are suitably staggered in the circumferential direction, the take-off roll of the present development exhibits the additional advantage that such vibrations can be eliminated or substantially reduced or suppressed in a most simple manner. Furthermore, it is possible to adjust the staggering of the teeth along the circumference of the take-off roll, so that is is possible to obtain optimum efficiency of the take-off roll in both rotational directions thereof.

Additionally, the possibility of embedding the half-discs in the cast cup members enables, within wide limits, selecting the most suitable material from which there are to be fabricated each of the parts. In this way it is possible, for instance, to maintain the weight of the cup member small by producing them from a light-weight material and to fabricate the teeth and/or toothed disc of a material of great hardness, so that there can be realized a long life span or longevity of the teeth.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
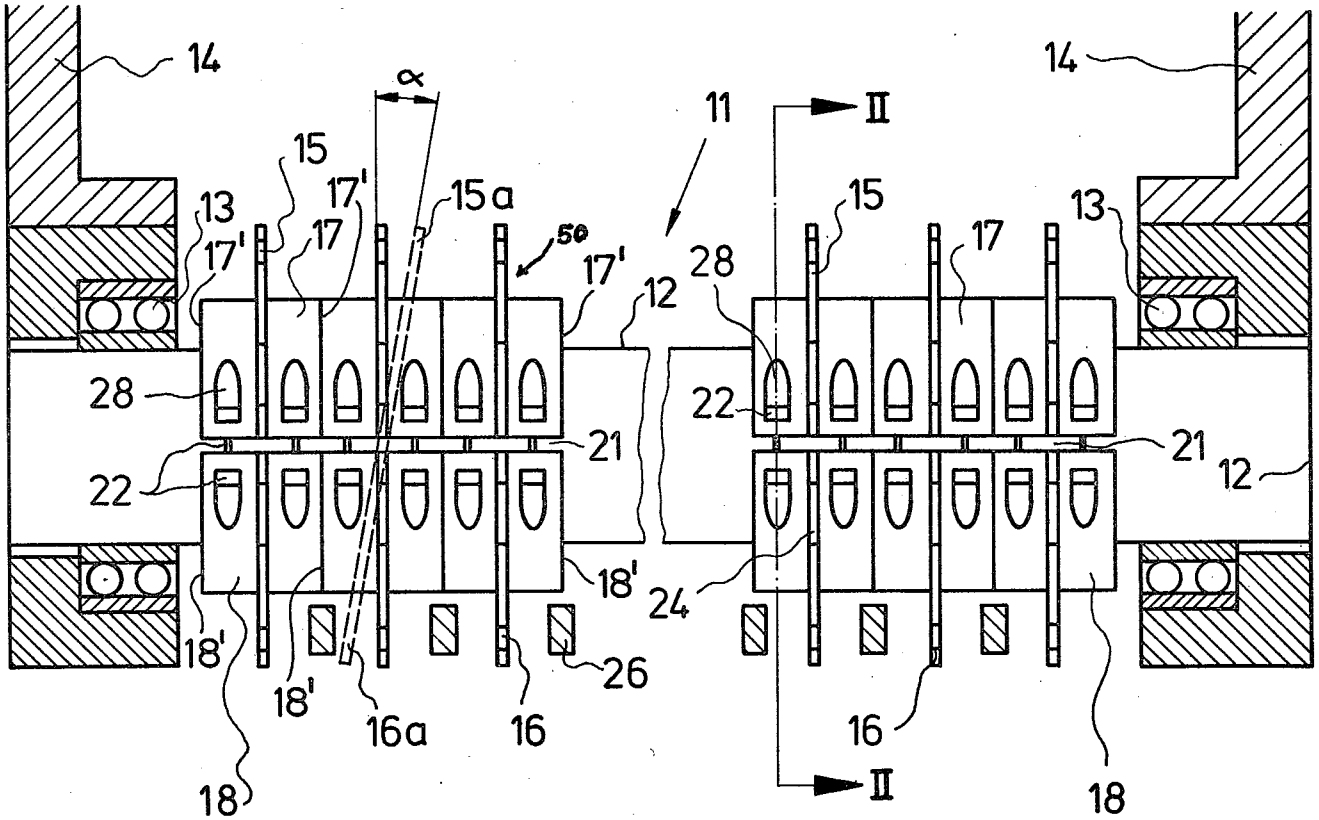
FIG. 1 is a side view of a take-off roll according to the invention.
Figure 2:
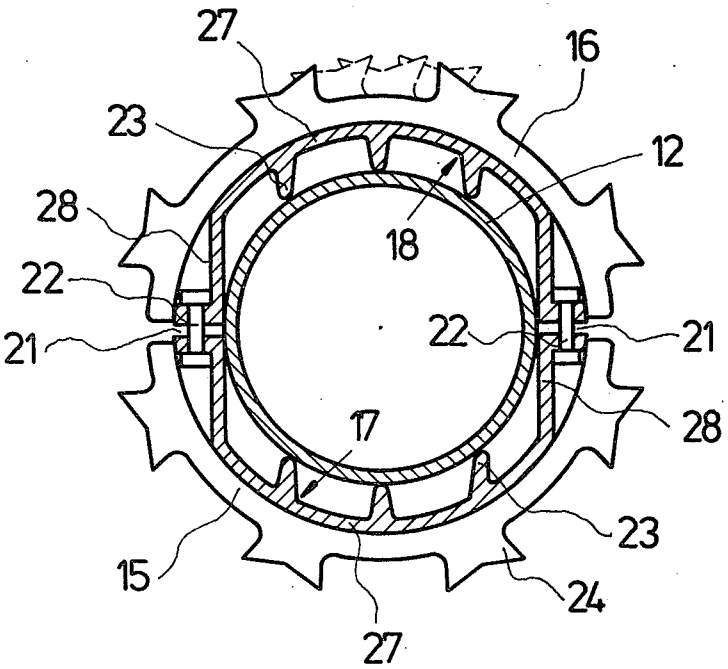
FIG. 2 is a cross-sectional view of the take-off roll shown in FIG. 1, taken substantially along the line II—II thereof.

Describing now the drawings, the take-off roll for fiber bales, as illustrated by way of example and not limitation in FIG. 1, will be seen to possess a shaft 12 which is also depicted in the section view of FIG. 2. This shaft 12 is rotatably mounted at both of its ends in bearings 13 or equivalent structure which, in turn, are carried by suitable support or mounting members 14. The rotatable shaft 12 is rotatably driven by any suitable drive means.

Upon the rotatable shaft 12 there are mounted discs or disc members, generally indicated by reference character 50 in FIG. 1. Each disc or disc member 50 comprises two substantially semi-circular or half-discs 15 and 16, both of which are arranged in the same plane. The half-disc 15 is embedded, for instance by being cast, in a cup member or shell 17 and the other semi-circular or half-disc 16 is embedably cast in a shell or cup member 18. The two cup members 17 and 18 surround the shaft 12 in a substantially ring-shaped fashion, but however are separated from one another by the slots 21, just as is also the case for the half-discs 15 and 16. These cup members 17 and 18 are releasably attached to one another by threaded bolts or screws 22 or equivalent fastening expedients, and thus, are pressed on to the shaft 12 and, in this manner, rigidly connected to such shaft 12 by means of a press fit. Each of the cup members or shells 17 and 18 is terminated at its opposed ends by end faces 17′ and 18′, respectively, and comprises a sleeve or jacket 27, as best seen by referring to FIG. 2, which possesses the form of a semi-circular or half cylinder with the exception of the minimal deviation from the true half cylinder shape which is predicated upon the existence of the slot 21. At the inner surface of each sleeve 27 there are provided the inwardly protruding projections or ribs 23. At the location of the threaded bolts 22 or the like the sleeve 27 is provided with recesses 28. The discs 50, each composed of the two half-discs 15 and 16, are arranged at essentially right angles with respect to the lengthwise axis of the related shaft 12. However, if necessary they also can be arranged at an inclination, for instance through the angle $\alpha$ with respect to the lengthwise axis of the shaft 12, as has been indicated for the phantom line illustrated discs 15*a* and 16*a* shown in FIG. 1. A plurality of such pairs of substantially semi-circular or half-discs 15 and 16 and related cup members or shells 17 and 18 is provided along the lengthwise extent of the shaft 12. In the exemplary embodiment under discussion the cup members 17 and 18 are arranged in adjacent side-by-side or juxtapositioned relationship.

Figure 3:
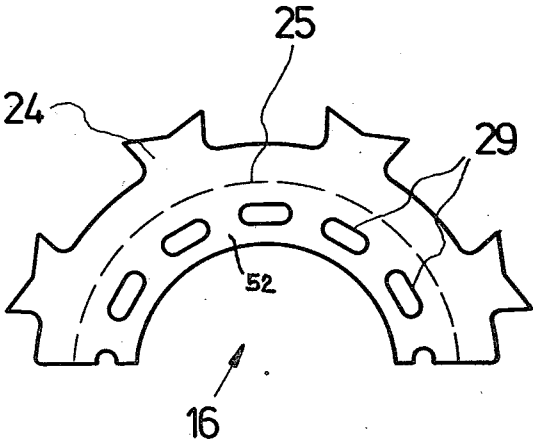
FIG. 3 is a side view of a semi-circular shaped or half disc.

For further clarity and to facilitate the understanding of the invention, FIG. 3 illustrates a single semi-circular or half-disc 16. These substantially semi-circular or half-discs 15 and 16 essentially possess the shape of a half circular ring. At their outer circumference they are provided with teeth 24. Each of the half-discs 15 and 16 is embedded in the related cup member or shell 17 and 18, over a half circular ring, with the exception of the recesses constituted by the slot 21. This half-circular ring, generally indicated by reference character 52 in FIG. 3, extends from its inner circumference towards the outside up to an imaginary half or semi-circle 25 within the appertaining cast cup member. In FIG. 3 the half or semi-circle 25 coincides with the outer surface of the sleeve 27 of the related cup member 17 or 18, as the case may be.

During the operation of the take-off roll 11 the rotatable shaft 12, and thus, also the discs 50, each composed of the two half-discs 15 and 16, are placed into rotation. During this process fiber flocks are therefore torn loose from the fiber bale which, for instance, is pressed against the grid bars or rods 26. These flocks are continuously sucked-off and are transported away for further processing, as is well known in this art. During this opening process the fiber bale can be moved, for instance, continuously back-and-forth along the grid bars or rods 26, the rotation of the shaft 12 being accomplished in the one rotational sense or the opposite rotational sense depending upon the desired direction of bale movement. If the discs or disc members 50, as indicated for instance for the semi-circular or half-discs 15*a* and 16*a* in FIG. 1, are arranged at an inclination with respect to the lengthwise axis of the shaft 12, then they perform a so-called reeling or wobbling motion. Consequently, practically the entire area between two neighboring grid bars 26 is swept by each related disc 50.

In the event that a tooth 24 of a half-disc 15 or 16 is damaged by a particle of foreign matter or contaminants present in the fiber bale, then the unit composed of the half-disc and cup member containing the damaged tooth, of the corresponding pair of semi-circular or half-discs 15 and 16 with their cup members or shells 17 and 18, is removed from the shaft 12 by loosening the threaded bolts 22, and a new undamaged unit is inserted in its place. This replacement or exchange operation can be perfected without the need to remove the shaft 12 and without the necessity of exerting any action or carrying out any other manipulations at the other half-discs 15 and 16 and cup members 17 and 18 provided on the shaft 12. Also, in the event of the normally expected wear of the pairs of half-discs 15 and 16 the replacement procedure can be accomplished in the same manner.

The danger of damage to the teeth 24 is appreciably reduced if they are fabricated from a hard material. Hard teeth 24 can be obtained if, for instance, there are used half-discs 15 and 16 formed of steel which are hardened at the location of the related teeth 24. If required, it would be possible to harden, in addition to the teeth 24, also a semi-circular ring-shaped area adjacent to the teeth 24 of the substantially semi-circular or half-discs 15 and 16 which extends, for instance, from the location of the teeth 24 to the imaginary half or semi-circle 25 (FIG. 3), or to also harden the entire half-disc.

If the total weight of the take-off roll 11 is to be maintained small, then the cup members or shells 17 and 18, as indicated in the exemplary illustrated embodiment, are not designed as massive elements. To achieve a reduced weight they can be fabricated, according to an advantageous construction of the invention, from aluminum.

Since the half-discs 15 and 16 embedded by casting in the cast cup members 17 and 18, there is achieved the appreciable advantage that the materials from which the discs and cup members are made can be chosen independently of one another to a large extent. In particulary, as heretofore mentioned, the half-discs 15 and 16 can be fabricated from steel and the cup members or shells 17 and 18 from aluminum.

The casting of the half-discs 15 and 16 in their related cup members or shells 17 and 18, respectively, can be advantageously accomplished by resorting to the use of conventional pressure molding or injection molding processes. If a particularly sturdy connection between the half-discs 15 and 16 and the cup members 17 and 18 is to be accomplished, then there can be beneficially provided at the half-discs 15 and 16 for this purpose suitable anchoring reinforcement means 29, which may be in the form of bores or small protuberances or raised portions. In FIG. 3 there have been illustrated, for instance, such bores 29 which conceptually can be also construed as small raised portions or protuberances.

It will be apparent from the foregoing discussion and the illustrations that the width of the cup members 17 and 18 is adapted to the spacing or distance between neighboring grid bars or rods 26, i.e. that the dimension of the cup members 17 and 18 in the longitudinal direction of the shaft 12 is essentially equal to the gauge of neighboring grid bars or rods 26. Since the cup members or shells 17 and 18 contact one another there is attained an additional rigidity or stiffening of the take-off roll 11 in a manner such that there can be dispensed with the use of spacer members between the joined pairs of cup members 17 and 18. The pairs of cup members or shells 17 and 18 also can be arranged, however, in the longitudinal direction of the shaft 12 so as to have a mutual spacing from one another.

In the uppermost portion of the illustration of FIG. 2 there has been depicted with broken or phantom lines a staggered arrangement of the discs 50, wherein the teeth 24 of neighboring toothed discs 50 are staggered by a certain desired amount along the circumference of the take-off roll 11 which, in the embodiment illustrated, corresponds to approximately one fourth of the distance between neighboring teeth 24 of a toothed disc.

While there are shown and described present preferred embodiments of the invention, it is to be distinctly understood that the invention is not limited thereto, but may be otherwise variously embodied and practiced within the scope of the following claims. Accordingly

What we claim is:

1. A take-off roll for mechanically opening fiber bales by loosening fiber flocks therefrom, comprising:

a rotatable shaft;

a number of substantially circular toothed discs mounted along and upon said rotatable shaft;

each of said substantially circular toothed discs having an outer circumference provided with teeth;

each of said circular toothed discs comprising two half-discs provided with said teeth;

each of said half-discs being configured as a substantially half circular ring member;

an approximately half-circular ring-shaped cup member provided for each half-disc;

each of said cup members defining a cast cup in which there is embedded a related one of the half discs;

predetermined ones of said cast cups each including one said half-disc embedded therein being arranged to collectively form a toothed disc surrounding said shaft in an essentially ring-shaped configuration; and means for releasably securing said cups forming said toothed disc to one another and for fixedly connecting said cups by a press fit with said shaft.

2. The take-off roll as defined in claim 1, wherein:

at least the teeth of said half-discs are formed of a hard material.

3. The take-off roll as defined in claim 2, wherein:

said hard material is hardened steel.

4. The take-off roll as defined in claim 1, wherein:

each of said half-discs has a zone adjacent to the teeth thereof; and the teeth of said half-discs and said zone of the half-discs adjacent to the teeth thereof are formed of a hard material.

5. The take-off roll as defined in claim 4, wherein:

said hard material is hardened steel.

6. The take-off roll as defined in claim 1, wherein:

said cups are formed of a relatively lightweight material.

7. The take-up roll as defined in claim 6, wherein:

said lightweight material is aluminum.

8. The take-off roll as defined in claim 1, wherein:

each of said cups comprise a sleeve member structured to define approximately one-half of a circular cylinder; and each of said sleeve members having an inner surface provided with ribs.

9. The take-off roll as defined in claim 1, wherein:

said cups are arranged adjacent one another along said shaft: and each of said cups having an end face; and said end faces of said cups being located in substantially vertical planes with respect to said shaft.

10. The take-off roll as defined in claim 1, wherein:

each of said toothed discs comprise two of said half-discs; and each of said half-discs being arranged in a plane which is inclined with respect to the shaft.

11. The take-off roll as defined in claim 1, further including:

connection means for mutually attaching to one another the cups of said half-discs which are assembled together into a toothed disc.

12. The take-off roll as defined in claim 11, wherein:

said connection means comprise at least one threaded connection element.

13. The take-off roll as defined in claim 1, wherein:

each half-disc is embedded in a related cast cup over an approximately half-circular ring-shaped zone which extends from an inner circumference thereof towards the outside over a portion of the half-disc.

14. The take-off roll as defined in claim 1, wherein:

each of said half-discs is embedded in a related cast cup; and each of said half-discs together with the related cast cup are joined together by means of pressure molding.

15. The take-off roll as defined in claim 1, wherein:

each of said half-discs is embedded in a related cast cup; and said half-discs together with the related cast cup are assembled together by means of injection molding.

16. The take-off roll as defined in claim 1, further including:

means provided for each of said half-discs and acting as a reinforcement for anchoring of the half-disc embedded in the related cast cup.

17. The take-off roll as defined in claim 16, wherein:

said reinforcement means comprise bores.

18. The take-off roll as defined in claim 16, wherein: said reinforcement means comprise protuberances.

19. The take-off roll as defined in claim 1, wherein:

said rotatable shaft defines a substantially cylindrical shaft; and each of said cup members having an internal configuration complementary to said cylindrical shaft, in order to enable said cup members to be selectively angularly positioned on said cylindrical shaft and fixed thereat in said selected position by said releasably securing means.

20. A take-off roll for mechanically opening fiber bales by loosening fiber flocks therefrom, comprising:

a rotatable shaft;

substantially circular toothed discs mounted along and upon said rotatable shaft;

said substantially circular toothed discs having an outer circumference provided with teeth;

each of said substantially circular toothed discs comprising two half-discs provided with said teeth;

each of said half-discs being configured as a substantially half circular ring member;

an approximately half-circular ring-shaped cup member provided for each half-disc;

each of said cup members defining a cast cup in which there is embedded a related one of the half discs;

said cast cups of said half-discs being arranged in pairs wherein said cast cups and half-discs of each pair collectively form a toothed disc surrounding said shaft in an essentially ring-shaped configuration; and means for releasably securing said cups in pairs to one another and for fixedly connecting said cups by means of a press fit with said shaft.

* * * * *